US011274665B2

(12) United States Patent
Kim et al.

(10) Patent No.: US 11,274,665 B2
(45) Date of Patent: Mar. 15, 2022

(54) LINEAR COMPRESSOR

(71) Applicant: LG Electronics Inc., Seoul (KR)

(72) Inventors: Hyunsoo Kim, Seoul (KR); Sangmin Lee, Seoul (KR); Sangeun Bae, Seoul (KR); Dongkyun Ha, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 16/938,673

(22) Filed: Jul. 24, 2020

(65) Prior Publication Data

US 2021/0088040 A1 Mar. 25, 2021

(30) Foreign Application Priority Data

Sep. 20, 2019 (KR) ..... 10-2019-0116389

(51) Int. Cl.

| | |
|---|---|
| ***F04B 39/12*** | (2006.01) |
| ***F04B 39/00*** | (2006.01) |
| ***F04B 53/00*** | (2006.01) |
| *F04B 35/04* | (2006.01) |

(52) U.S. Cl.

CPC ..... *F04B 39/121* (2013.01); *F04B 39/0038* (2013.01); *F04B 39/0044* (2013.01); *F04B 35/045* (2013.01); *F04B 53/003* (2013.01)

(58) Field of Classification Search

CPC ..... F04B 39/121; F04B 39/0038; F04B 39/0044; F04B 53/003; F04B 35/045; F25B 9/002; F25B 19/005; F25B 49/02; F05B 2260/964; F05B 2210/14

See application file for complete search history.

(56) References Cited

U.S. PATENT DOCUMENTS

2017/0298913 A1* 10/2017 Kim ..... F04B 9/06
2017/0321674 A1* 11/2017 Ha ..... F04B 19/22
2017/0321681 A1* 11/2017 Lee ..... F04B 35/045

FOREIGN PATENT DOCUMENTS

| | | |
|---|---|---|
| EP | 3242019 | 11/2017 |
| KR | 20160009306 | 1/2016 |
| KR | 1020170124900 | 11/2017 |

(Continued)

OTHER PUBLICATIONS

KR20180039913 translation (Year: 2021).*

(Continued)

*Primary Examiner* — Devon C Kramer
*Assistant Examiner* — David N Brandt
(74) *Attorney, Agent, or Firm* — Fish & Richardson P.C.

(57) ABSTRACT

A linear compressor may include a shell, a shell cover, a compressor body disposed in the shell, and a support device configured to connect the compressor body to the shell cover to prevent the compressor body from contacting an inner peripheral surface of the shell. The support device includes a support spring formed with a hole in a central portion and having a spiral spring arm extending from the central portion to an outer portion, at least a portion of the outer portion being connected to the compressor body, a rigid connection portion spaced apart from the support spring by a predetermined distance, and an elastic connection portion formed to surround at least a portion of a periphery of the hole of the support spring to connect the support spring and the rigid connection portion and coupled to the shell cover.

20 Claims, 11 Drawing Sheets

(56) References Cited

FOREIGN PATENT DOCUMENTS

| | | | | |
|---|---|---|---|---|
| KR | 20180039913 | * | 4/2018 | ..... F04B 25/04 |
| KR | 1020180039913 | | 4/2018 | |
| KR | 1020180040791 | | 4/2018 | |
| KR | 1020180100878 | | 9/2018 | |

OTHER PUBLICATIONS

EP extended European search report, in European Appln. No. 20188544.9, dated Oct. 26, 2020, 5 pages.
Korean Notice of Allowance in Korean Appln. No. 10-2019-0116389, dated Mar. 26, 2021, 3 pages (with English translation).

* cited by examiner

LINEAR COMPRESSOR

CROSS-REFERENCE TO RELATED APPLICATION

This application is based on and claims the benefit of priority to Korean Patent Application No. 10-2019-0116389, filed on Sep. 20, 2019, in the Korean Intellectual Property Office, the disclosure of which is incorporated herein in its entirety by reference.

TECHNICAL FIELD

The present disclosure relates to a linear compressor utilized in various electronic devices.

BACKGROUND

A heat pump system is a system that circulates a refrigerant to transfer heat from a specific place to another place, and repeatedly performs compression, condensation, expansion, and evaporation processes of the refrigerant. To this end, the heat pump system includes a compressor, a condenser, an expansion valve, and an evaporator. A typical home appliance using such a heat pump system is a refrigerator or an air conditioner.

A main power source of refrigerant circulation in the heat pump system is a compressor, and the compressor may be roughly classified into a reciprocating compressor, a rotary compressor, and a scroll compressor.

The reciprocating compressor has a compression space through which a working gas is sucked or discharged between a piston and a cylinder to compress a refrigerant in such a way that the piston linearly reciprocates inside the cylinder, and the rotary compressor has a compression space through which a working gas is sucked or discharged between a roller and a cylinder to compress a refrigerant in such a way that the roller eccentrically rotates along the inner wall of the cylinder. The scroll compressor has a compression space through which a working gas is sucked or discharged between an orbiting scroll and a fixed scroll to compress refrigerant in such a way that the orbiting scroll rotates along the fixed scroll.

Recently, among the reciprocating compressors, development has been actively conducted on a linear compressor in which a piston is directly connected to a driving motor that reciprocates linearly to simplify a structure and minimize mechanical loss due to motion switching.

Korean Patent Publication No. 10-2016-0009306, which is a prior art document, discloses a linear compressor and a refrigerator including the same.

The linear compressor has a compressor body embedded in a compressor casing and includes a body support portion (a support device) for supporting the compressor body. The body support portion is provided at both ends of the compressor body along the axial direction of the compressor, so that the compressor casing and the compressor body do not directly contact each other.

The compressor body includes a cylinder that compresses a refrigerant introduced from a suction portion and discharges the compressed refrigerant through a discharge portion, a piston that reciprocates linearly inside the cylinder, and a motor assembly that provides a driving force to the piston.

However, according to the prior art document, there is a problem in that vibration and noise occurring during the operation of the compressor body are transmitted to the compressor casing of the compressor by the support device, thereby causing vibration noise.

SUMMARY

The present disclosure may provide a linear compressor of which a compressor body is prevented from colliding with a shell and a shell cover of the compressor during the operation of a compressor body.

The present disclosure may provide a linear compressor capable of reducing the occurrence of noise by blocking a path through which vibration occurring in a compressor body is transmitted to a shell of a compressor during the operation of the compressor body.

Particular implementations of the present disclosure herein provide a linear compressor that may include a shell, a shell cover, a compressor body, and a support device. The shell cover may cover an open end of the shell. The compressor body may be disposed in the shell and configured to compress a refrigerant. The support device may connect the compressor body to the shell cover and prevent the compressor body from contacting an inner peripheral surface of the shell. The support device may include a support spring, a rigid connection portion, and an elastic connection portion. The support spring may have a central portion and an outer portion. The support spring may define a hole at the central portion. The support spring may have a spiral spring arm that extends from the central portion to the outer portion. At least a portion of the outer portion may be connected to the compressor body. The rigid connection portion may be spaced apart from the support spring. The elastic connection portion may at least partially surround the hole of the support spring. The elastic connection portion may connect the support spring to the rigid connection portion. The elastic connection portion may be coupled to the shell cover.

In some implementations, the linear compressor may optionally include one or more of the following features. The support spring may have a plate spring shape and include a plurality of spiral spring arms that extend from a plurality of points at the central portion toward the outer portion. The plurality of points may be spaced equally from each other at the central portion. The plurality of spiral spring arms may spirally extend from three or more of the plurality of points at the central portion toward the outer portion. The plurality of spiral spring arms may be connected to each other and define a circle at the outer portion. The rigid connection portion may include a rigid flange that faces the central portion of the support spring and that is spaced apart from the support spring. The rigid connection portion may include a rigid protrusion that is connected to the rigid flange, that protrudes from the rigid flange along an axial direction of the compressor body, and that provides an internal frame of the elastic connection portion. The central portion of the support spring may include a first alignment hole. The rigid flange may include a second alignment hole. The first alignment hole may be disposed to partially correspond to the second alignment hole. The central portion of the support spring may include a plurality of first alignment holes that are disposed at positions of the central portion from which the spiral spring arm extends. The plurality of first alignment holes may be equally spaced from each other along a circumferential direction around the hole of the support spring. The elastic connection portion may include an elastic flange and an elastic protrusion. The elastic flange may surround the rigid flange and the central portion of the support spring. The elastic protrusion may surround the rigid protrusion and be coupled to the shell cover. The elastic flange may surround the central portion of the support spring and at least a portion of the spring arm. The elastic protrusion may have a groove that extends from an outer peripheral surface of the compressor body toward an axis of the compressor body. The groove may be disposed closer to the elastic flange than the shell cover. An exterior of the elastic protrusion may have a square pillar shape. A central axis of the rigid protrusion may be offset from a central axis of the elastic protrusion. The elastic protrusion may be disposed at an edge of the elastic connection portion and be parallel to the axial direction of the linear compressor. The edge of the elastic connection portion may include a strain absorbing groove that extends toward the axis of the linear compressor. The elastic protrusion may have fixing protrusions that are disposed at opposite surfaces of the elastic protrusion. The shell cover may include a cover support portion that is coupled to the elastic protrusion. The cover support portion may include fixing grooves that correspond to the fixing protrusions of the elastic protrusion. The cover support portion may have a shape that corresponds to the elastic protrusion and have a rectangular cross section along the axial direction of the compressor body. The cover support portion may have a chamfered axial edge. Each edge of the cover support portion may have an axial length that is shorter than an axial length of an edge of the elastic protrusion that corresponds to the edge of the cover support portion. The shell cover may include a cover support portion that is coupled to the elastic protrusion. The elastic protrusion may be press-fitted to the cover support portion. The rigid protrusion may be spaced apart from the cover support portion that is coupled to the elastic protrusion. The linear compressor may include an inlet guide portion that extends through the hole in the central portion of the support spring and that is configured to supply the refrigerant to a cylinder of the compressor body. The rigid connection portion and the elastic connection portion may have a hole that extends through a center between the rigid connection portion and the elastic connection portion and that receives the inlet guide portion.

According to an aspect of the present disclosure, a linear compressor may include a shell having a cylindrical shape with both ends open to form an inner space, a shell cover covering both ends of the shell, a compressor body disposed in the shell to compress refrigerant, and a support device configured to connect the compressor body to the shell cover to prevent the compressor body from contacting an inner peripheral surface of the shell, wherein the support device includes a support spring formed with a hole in a central portion and having a spiral spring arm extending from the central portion to an outer portion, at least a portion of the outer portion being connected to the compressor body, a rigid connection portion spaced apart from the support spring by a predetermined distance, and an elastic connection portion formed to surround at least a portion of a periphery of the hole of the support spring to connect the support spring and the rigid connection portion and coupled to the shell cover.

Further, the support spring may have a plate spring shape and may be formed such that a plurality of spiral spring arms extend from a plurality of points placed at equal intervals in the central portion toward the outer portion.

Further, the spring arm spirally may extend from at least three or more points in the central portion toward the outer portion.

Further, the spring arm may be connected to form a circle in the outer portion

Further, the rigid connection portion may include a rigid flange facing the central portion of the support spring and spaced apart from the support spring by a predetermined distance, and a rigid protrusion connected to the rigid flange and protruding from the rigid flange toward an axial direction of the compressor body to provide an internal frame of the elastic connection portion.

Further, the central portion of the support spring may be formed with a first alignment hole, and the rigid flange may be formed with a second alignment hole, a position of the first alignment hole and a position of the second alignment hole corresponding to each other.

Further, the central portion of the support spring may be formed with a plurality of the first alignment holes, and the first alignment holes may be formed at positions corresponding to positions where the spring arm extends.

Further, the elastic connection portion may include an elastic flange surrounding the rigid flange and the central portion of the support spring and an elastic protrusion surrounding the rigid protrusion and coupled to the shell cover.

Further, the elastic flange may be formed to surround the central portion of the support spring and at least a portion of the spring arm.

Further, the elastic protrusion may have a groove recessed toward an axis of the compressor body formed in an outer peripheral surface thereof, and the groove may be disposed closer to the elastic flange than the shell cover.

Further, the elastic protrusion may be formed to have an outer shape of a square pillar shape, and may be disposed such that a center of the rigid protrusion is arranged to be out of a center of the elastic protrusion when viewed in the axial direction of the compressor body.

Further, an edge of the elastic protrusion parallel to the axial direction of the compressor may be chamfered.

Further, the elastic protrusion may have fixing protrusions formed in two surfaces facing each other among outer peripheral surfaces of the elastic protrusion.

Further, the shell cover may be formed with a cover support portion coupled to the elastic protrusion, and the cover support portion may be formed with a fixing groove at positions corresponding to positions of the fixing protrusions.

Further, the cover support portion may be formed to correspond to a shape of the elastic protrusion and may be provided to have a rectangular cross section when viewed in the axial direction of the compressor body, and an axial edge of the cover support portion may be configured to be chamfered.

Further, each of edges of the cover support portion may have a length shorter than a length of an edge of the elastic protrusion corresponding to the edge of the cover support portion and parallel to the axial direction.

DETAILED DESCRIPTION

Figure 1:
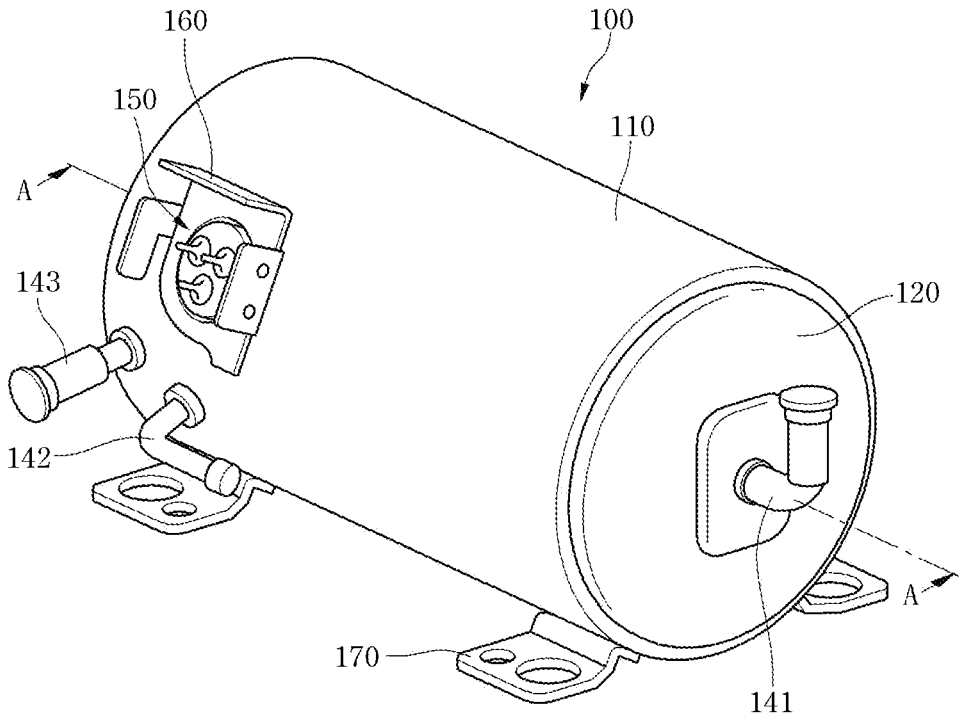
FIG. 1 is an external perspective view showing a configuration of a linear compressor according to an embodiment of the present disclosure.

Hereinafter, the embodiments disclosed herein will be described in detail with reference to the accompanying drawings, and the same or similar elements are designated with the same numeral references regardless of the numerals in the drawings and their redundant description will be omitted. The suffixes "module" and "unit or portion" for components used in the following description are merely provided only for facilitation of preparing this specification, and thus they are not granted a specific meaning or function. In addition, when it is determined that the detailed description of the related known technology may obscure the gist of embodiments disclosed herein in describing the embodiments, a detailed description thereof will be omitted. Further, the accompanying drawings are intended to facilitate understanding of the embodiments disclosed herein, and the technical spirit disclosed herein are not limited by the accompanying drawings. Therefore, the present disclosure should be construed as including all the changes, equivalents, and substitutions included in the spirit and scope of the present disclosure.

The terms coming with ordinal numbers such as 'first', 'second', or the like may be used to denote various components, but the components are not limited by the terms. The terms are used merely for the purpose to distinguish a component from the other component.

It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

As used herein, singular forms may include plural forms as well unless the context clearly indicates otherwise.

It will be further understood that the terms "comprises," "comprising," "having," "having," "includes," "including" and/or variations thereof, when used in this specification, specify the presence of stated features, integers, steps, operations, elements, and/or components, but do not preclude the presence or addition of one or more other features, integers, steps, operations, elements, components, and/or groups thereof.

Figure 2:
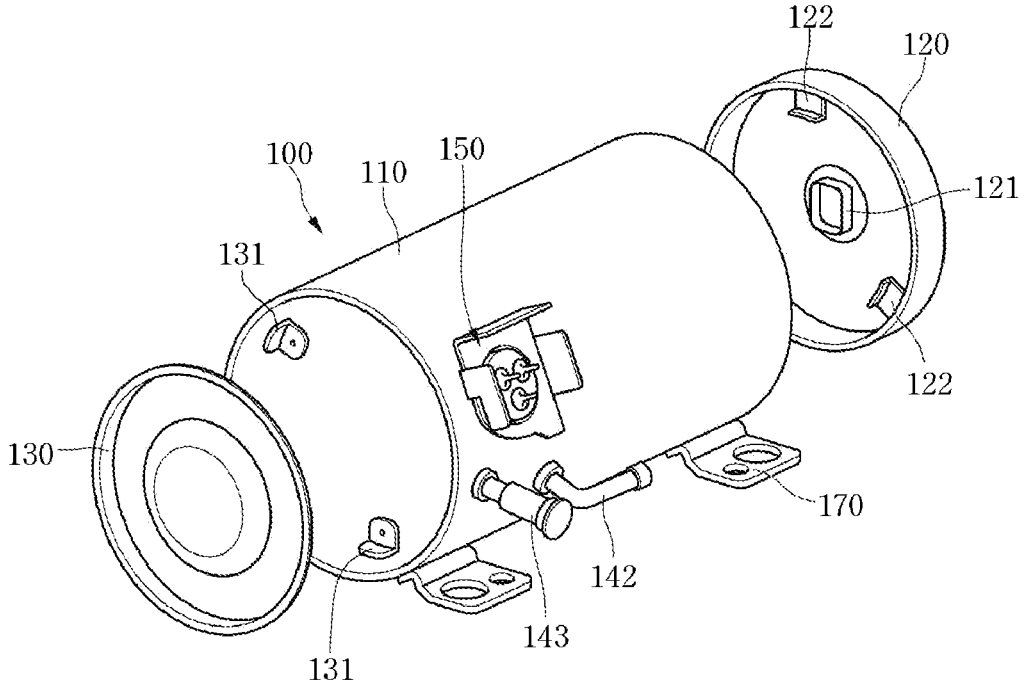
FIG. 2 is an exploded perspective view of a shell and a shell cover of a linear compressor according to an embodiment of the present disclosure.

FIG. 1 is an external perspective view showing a configuration of a linear compressor according to an embodiment of the present disclosure, and FIG. 2 is an exploded perspective view of a shell and a shell cover of a linear compressor according to an embodiment of the present disclosure.

Referring to FIGS. 1 and 2, a linear compressor 100 according to the present disclosure may include a shell 110 and shell covers 120 and 130 coupled to the shell 110.

To help understanding of the linear compressor 100 according to an embodiment of the present disclosure, the shell covers 120 and 130 are separated from the shell 110, but it can be understood that, in a broad sense, the shell covers 120 and 130 are parts of the shell 110.

A leg 170 may be coupled to a lower portion of the shell 110. The leg 170 may be coupled to a base of a product in which the linear compressor 100 is installed.

For example, the leg 170 may be installed in the base of a machine room of a refrigerator or may be installed in the base of an outdoor unit of an air conditioner.

The shell 110 according to an embodiment may have a substantially cylindrical shape and may be disposed to be laid in a traverse direction or to be laid in an axial direction. Referring to FIG. 1, the shell 110 extends to elongate in the transverse direction and may have a somewhat lower height in a radial direction. That is, since the linear compressor 100 is capable of having a low height, it is possible to reduce the height of the machine chamber when the linear compressor 100 is installed in the base of the machine chamber base of the refrigerator.

In other words, a longitudinal center axis of the shell 110 coincides with a center axis of the compressor body, which will be described later, and the central axis of the compressor body coincides with central axes of a cylinder and a piston constituting the compressor body.

A terminal 150 according to an embodiment may be disposed on the outer surface of the shell 110. The terminal 150 may transfer external power to a motor 1140 (see FIG. 3) of the linear compressor 100.

A bracket 160 according to an embodiment may be disposed outside the terminal 150. The bracket 160 may function to protect the terminal 150 from an external impact.

Both sides of the shell 110 according to an embodiment may be open. The shell covers 120 and 130 may be coupled to both open sides of the shell 110.

More specifically, the shell covers 120 and 130 may include a first shell cover 120 coupled to one side of the shell 110 and a second shell cover 130 coupled to the other side of the shell 110. The inner space of the shell 110 may be sealed by the first and second shell covers 102 and 103.

Referring to FIG. 1, the first shell cover 120 may be located on the right side of the linear compressor 100, and the second shell cover 130 may be located on the left side of the linear compressor 100.

In other words, it may be understood that the first and second shell covers 102 and 103 are disposed to face each other.

In addition, the first shell cover 102 may be located on the suction side of the refrigerant, and the second shell cover 103 may be located on the discharge side of the refrigerant.

The linear compressor 10 according to an embodiment of the present disclosure may further include a plurality of pipes 141, 142 and 143 provided in the shell 101 or the shell covers 102 and 103 to suck, discharge or inject refrigerant.

Specifically, the plurality of pipes 141, 142, and 143 may include a suction pipe 141 for supplying the refrigerant to the inside of the linear compressor 100, a discharge pipe 142 for discharging the compressed refrigerant to the linear compressor 100, and a process pipe 106 for causing the linear compressor 10 to be replenished with a refrigerant.

The suction pipe 141 according to an embodiment may be coupled to the first shell cover 120. The refrigerant may be sucked into the linear compressor 100 along the axial direction through the suction pipe 141.

The discharge pipe 142 according to an embodiment may be coupled to an outer peripheral surface of the shell 110. The refrigerant sucked through the suction pipe 141 may be compressed while flowing in the axial direction. The compressed refrigerant may be discharged through the discharge pipe 142.

The process pipe 143 according to an embodiment may be coupled to the outer peripheral surface of the shell 110. An operator may inject a refrigerant into the linear compressor 100 through the process pipe 143.

The process pipe 143 may be coupled to the shell 110 at a different height from that of the discharge pipe 142 to avoid interference with the discharge pipe 142. The height may be understood as a distance spaced apart from the leg 170 in a direction perpendicular to the leg 170 (or a radial direction). The discharge pipe 142 and the process pipe 143 are coupled to the outer peripheral surface of the shell 110 at the different heights, thereby improving work convenience.

A cover support portion 121 may be formed on an inner surface of the first shell cover 120 according to an embodiment. A first support device 1230 (see FIG. 3), which will be described later, may be coupled to the cover support portion 121. The cover support portion 121 and the first support device 1230 may be understood as a device that supports a compressor body 1000 (see FIG. 3) of the linear compressor 100.

A stopper 122 may be provided on the inner surface of the first shell cover 120 according to an embodiment. The stopper 122 may prevent the body of the compressor, in particular, a motor 1140 from being damaged by collision with the shell 101 due to vibration, impact, or the like occurring during transport of the linear compressor 10.

In particular, the stopper 122 is positioned adjacent to the rear cover 1220 to be described below so that when the linear compressor 100 is shaken, the rear cover 1220 interferes with the stopper 122, thereby preventing impact from being transferred to the motor 1140.

A spring fastening portion 131 may be provided on the inner peripheral surface of the shell 110 according to an embodiment. As one example, the spring fastening portion 131 may be disposed at a position adjacent to the second shell cover 130. The spring fastening portion 131 may be coupled to a second support spring 1241 (see FIG. 3) of a second support device 1240 (see FIG. 3), which will be described later. The body of the compressor may be stably supported on the inner side of the shell 101 by the engagement of the spring fastening portion 131 and the second support device 1240.

Figure 3:
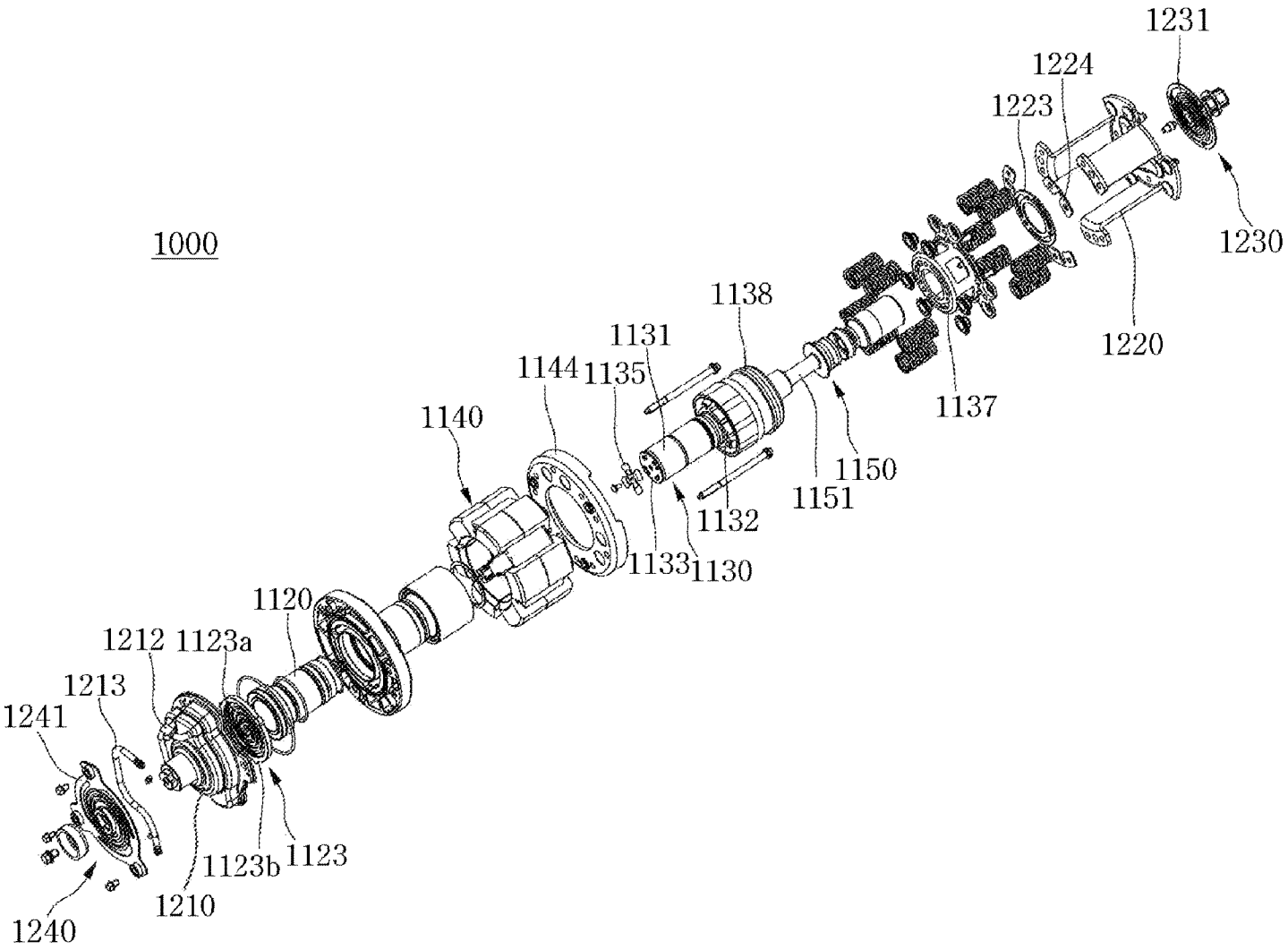
FIG. 3 is an exploded perspective view of internal parts of a linear compressor according to an embodiment of the present disclosure.
Figure 4:
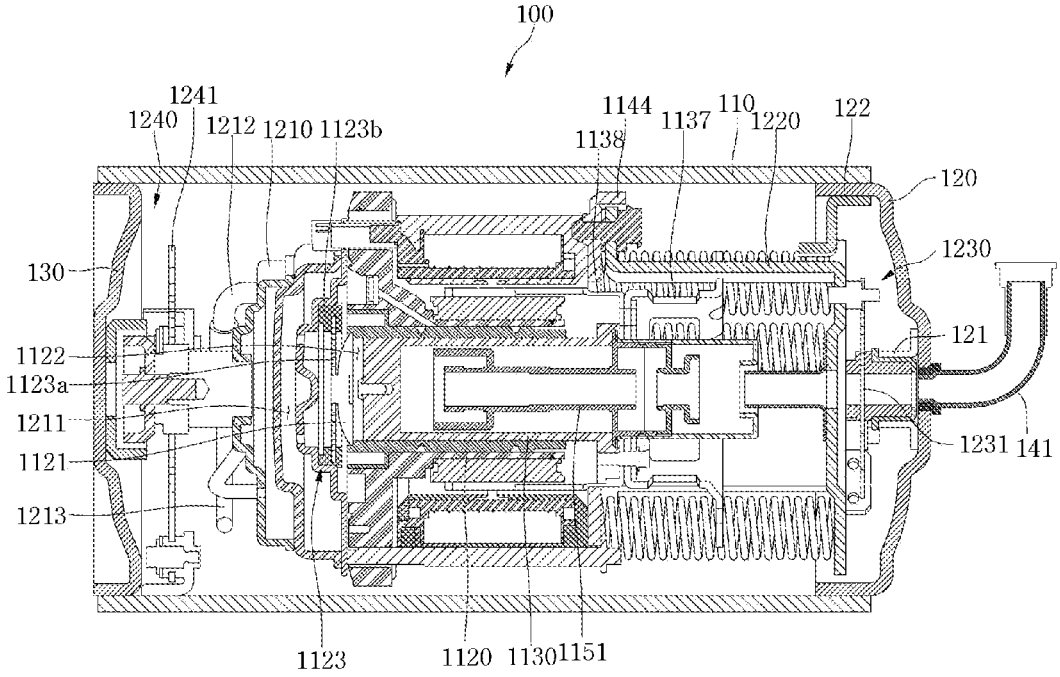
FIG. 4 is a cross-sectional view taken along line A-A of FIG. 1.

FIG. 3 is an exploded perspective view of internal parts of a linear compressor according to an embodiment of the present disclosure, and FIG. 4 is a cross-sectional view taken along line A-A of FIG. 1.

In describing the linear compressor 100 according to various embodiments of the present disclosure, definitions for directions will be described to help understanding as follows. However, the definitions are not absolute, and when definition of one of the directions is changed, the remaining directions may be changed correspondingly.

The term "axial direction" according to an embodiment may mean a direction in which a piston 1130 reciprocates and may be understood in a left-right direction based on the illustrated state of FIG. 4. Among the "axial directions", a direction from the suction pipe 141 toward a compression space 1122, that is, the direction into which the refrigerant flows (e.g., the left direction based on FIG. 4), may be referred to as "front direction" and the opposite direction thereto may be referred to as "rear direction" (e.g., the right direction based on FIG. 4). The "radial direction" is a direction perpendicular to the direction in which the piston 1130 reciprocates and may be understood in the up-down direction based on the illustrated state of FIG. 4.

In addition, the "down direction" among the up and down directions may be understood as a direction in which the weight of the compressor body 1000 is applied.

The term "axis of the compressor body" may mean an axial centerline of the piston 1130. The axial centerline of the piston 1130 may pass through the first shell cover 120 and the second shell cover 130.

Referring to FIGS. 3 and 4, the linear compressor 100 according to an embodiment of the present disclosure, may include a compressor body 1000 and one or more support devices 1230 and 1240 that support the compressor body 1000 on one or more of the shell 110 and the shell covers 120 and 130. The one or more support devices 1230 and 1240 may support the compressor body 1000 such that the compressor body 1000 is maintained to be spaced apart from the shell 110.

The compressor body 1000 according to an embodiment may include a cylinder 1120 provided inside the shell 110, a piston 1130 reciprocating linearly inside the cylinder 1120 and a motor 1140 that provides driving force to the piston 1130. When the motor 1140 is driven, the piston 1130 may reciprocate in the axial direction.

The piston 1130 according to an embodiment may include a piston body 1131 having a substantially cylindrical shape and a piston flange portion 1132 extending radially from the piston body 1131. The piston body 1131 may reciprocate inside the cylinder 1120 and the piston flange portion 1132 may reciprocate outside the cylinder 1120.

The cylinder 1120 according to an embodiment may accommodate at least a portion of a first muffler 1151 and at least a portion of the piston body 1131.

A compression space 1122 in which a refrigerant is compressed by the piston 1130 may be formed inside the cylinder 1120. A suction hole 1133 for introducing refrigerant into the compression space 1122 may be formed in a front portion of the piston body 1131 and a suction valve 1135 which selectively open the suction hole 1133 may be provided in front of the suction hole 1133.

In front of the compression space 1122 according to an embodiment, a discharge cover 1210 defining a discharge space 1211 of the refrigerant discharged from the compression space 1122 and discharge valve assemblies 1121 and 1123 that selectively discharge the compressed refrigerant from the compression space 1122 may be provided.

The discharge valve assemblies 1121 and 1123 according to an embodiment of the present disclosure may include a discharge valve 1121 and a spring assembly 1123. The discharge space 1211 may include a plurality of space parts partitioned by the inner wall of the discharge cover 1210.

The plurality of space parts are arranged in the front-rear direction and may communicate with each other.

The compression space 1122 of the linear compressor 100 according to an embodiment may be formed through the cylinder 1120, the piston 1130 and the discharge valve 1121. Among them, the discharge valve 1121 may serve to discharge refrigerant when the refrigerant introduced into the compression space 1122 is compressed above a certain pressure.

The discharge valve 1121 may be provided with an elastic force through the spring assembly 1123 disposed between the discharge cover 1210 and the discharge valve 1121 to open or close one side of the cylinder 1120 based on the provided elastic force.

The spring assembly 1123 may include a valve spring 1123*a* and a spring support portion 1123*b*. The valve spring 1123*a* may press the discharge valve 1121 so that the discharge valve 1121 is maintained to close the opened one side of the cylinder 1120.

The operation of the discharge valve 1121 and the spring assembly 1123 according to an embodiment will be described below. When the piston 1130 reciprocates linearly inside the cylinder 1120, a refrigerant may be compressed in the compression space 1122, and the pressure of the compression space 1122 gradually increases, thus increasing a fore of pushing out the discharge valve 1121. When the pressure of the refrigerant is greater than the elastic force of the valve spring 1123*a*, the discharge valve 1121 may be pushed axially to open one side of the cylinder 1120, and the refrigerant may be discharged from the cylinder 1120. When the refrigerant is discharged and the pressure in the compression space 1122 is lowered, the discharge valve 1121 may again close the one side of the cylinder 1120 by the elastic force of the valve spring 1123*a*. As the above process is repeatedly made, the linear compressor 100 may compress the refrigerant to a high pressure.

The compressor body 1000 according to an embodiment may further include a cover pipe 1212 coupled to the discharge cover 1210 to discharge refrigerant flowing through the discharge space 1211 of the discharge cover 1210. In one example, the cover pipe 1212 may be made of a metal material.

In addition, the compressor body 1000 may further include a loop pipe 1213 coupled to the cover pipe 1212 to transfer refrigerant flowing through the cover pipe 1212 to the discharge pipe 142. One side of the loop pipe 1213 may be coupled to the cover pipe 1212, and the other side may be coupled to the discharge pipe 142.

The loop pipe 1213 according to an embodiment is made of a flexible material. The loop pipe 1213 may extend roundly along the inner peripheral surface of the shell 110 from the cover pipe 1212 to be coupled to the discharge pipe 142. In one example, the loop pipe 1213 may be disposed to be wound.

The compressor body 1000 according to an embodiment may further include a supporter 1137 supporting the piston 1130. The supporter 1137 may be coupled to the rear side of the piston 1130 and may be disposed such that the muffler 1150 passes through the supporter 1137. The piston flange portion 1132, a magnet frame 1138 and the supporter 1137 may be fastened by a fastening member.

A balance weight 1223 may be coupled to the supporter 1137 according to an embodiment. The weight of the balance weight 1223 may be determined based on an operation frequency range of the compressor body 1000.

The linear compressor 100 according to an embodiment may further include a rear cover 1220 coupled to a stator cover 1144 and extending rearward. Specifically, the rear cover 1220 may be coupled to a rear surface of the stator cover 1144. A spacer 1224 may be interposed between the rear cover 1220 and the stator cover 1144. The distance from the stator cover 1144 to the rear end of the rear cover 1220 may be determined by adjusting the thickness of the spacer 1224. In addition, the rear cover 1220 may be spring-supported on the supporter 1137.

Figure 5:
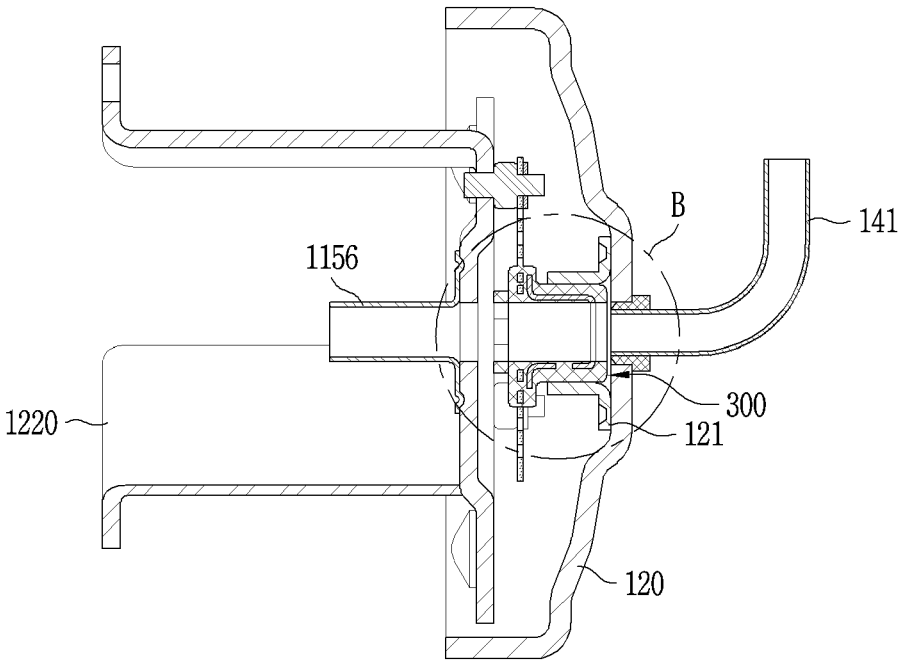
FIG. 5 is a cross-sectional view mainly showing a support device of a linear compressor of which some components are omitted, according to an embodiment of the present disclosure.
Figure 6:
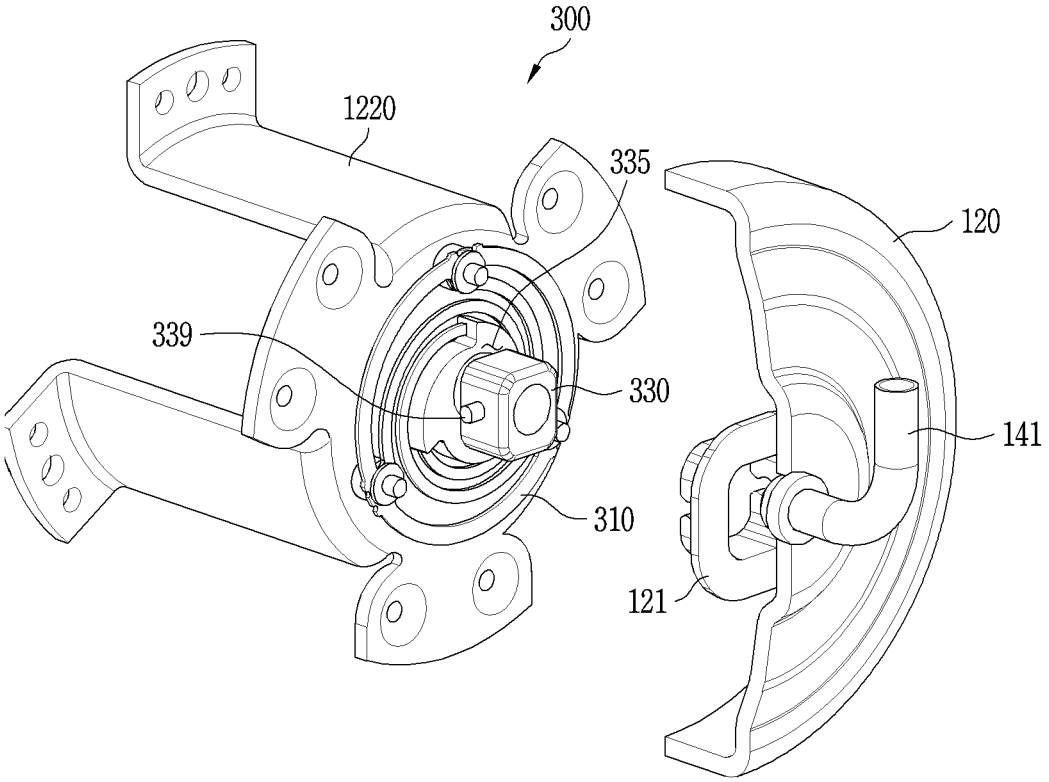
FIG. 6 is an exploded perspective view mainly showing a support device of a linear compressor of which some components are omitted, according to an embodiment of the present disclosure.

FIG. 5 is a cross-sectional view mainly showing a support device 300 of a linear compressor 100 (see FIG. 4) of which some components are omitted, according to an embodiment of the present disclosure. For example, the support device 300 of the linear compressors 100 of FIG. 4 positioned on the suction side of the refrigerant is mainly shown. FIG. 6 is an exploded perspective view mainly showing a support device 300 of a linear compressor 100 of which some components are omitted, according to an embodiment of the present disclosure. For example, the support device 300 of the linear compressor 100 shown in FIG. 5 and surrounding components are shown in a perspective view such that they can be easily grasped.

A plurality of support devices 300 according to an embodiment of the present disclosure may be arranged. For example, a first support device 1230 (see FIG. 4) connecting one side of the compressor body 1000 with the first shell cover 120 and a second support device 1240 (see FIG. 4) connecting the other side of the compressor body 1000 with the second shell cover 130 (see FIG. 4) with respect to the compressor body 1000 (see FIG. 3)

The one side of the compressor body 1000 may mean a direction in which a refrigerant is sucked, and the other side of the compressor body 1000 may mean a direction in which the refrigerant is discharged. Accordingly, the first support device 300 may be referred to as a suction side support device 300, and the second support device 1240 may be referred to as a discharge side support device 1240.

The plurality of support devices 300 according to an embodiment may float the compressor body 1000 in an inner space defined by the shell 110 and the shell covers 120 and 130 to prevent the compressor body 1000 from directly colliding with the shell 110 and the shell cover 120 and 130.

The support device 300 of the linear compressor 100 according to an embodiment of the present disclosure may be the same as or similar to the first support device 1230 shown in FIGS. 1 to 4. In addition, in describing the support device 300 of the linear compressor 100 according to an embodiment, the support device positioned on the suction side of the linear compressor 100 may be mainly described. This is to aid understanding of the support device 300 of the linear compressor 100 according to an embodiment, and the support device 300 is not limited to being disposed on the suction side of the linear compressor 100.

Referring to FIGS. 5 to 6, the compressor body 1000 may be coupled to the first shell cover 120 through the rear cover 1220, the support device 300, and the cover support portion 121.

The support device 300 according to an embodiment may include a support spring 310, a rigid connection portion 320, and an elastic connection portion 330.

It is possible to couple one side of the compressor body 1000 to the first shell cover 120 in such a way that the support spring 310 of to the support device 300 is coupled with the rear cover 1220 and the rigid connection portion 320 and the elastic connection portion 330 are inserted and coupled to the cover support portion 121.

Both the support spring 310 and the rigid connection portion 320 may be coupled to the elastic connection portion 330.

According to an embodiment, the support spring 310 and the rigid connection portion 320 may be arranged to be spaced apart from each other by a predetermined distance, and may be coupled to each other while maintaining a certain distance (predetermined distance) through the elastic connection portion 330.

In other words, the support spring 310 and the rigid connection portion 320 may be spaced apart from each other by a certain interval while the support spring 310 and the rigid connection portion 320 are coupled to the elastic connection portion 330.

The elastic connection portion 330 may be formed by an insert injection molding method in which the support spring 310 and the rigid connection portion 320 are used as inserts.

The support spring 310 and the rigid connection portion 320 are arranged to be spaced apart from each other by a predetermined interval and are maintained in the spaced state through coupling with the elastic connection portion 330 so that the vibration occurring in the compressor body 1000 may be absorbed and blocked through the elastic connection portion 330.

Therefore, the vibration occurring in the compressor body 1000 is absorbed and blocked by the elastic connection portion 330, thus preventing the vibration from being directly transferred to the first shell cover 120.

Figure 7:
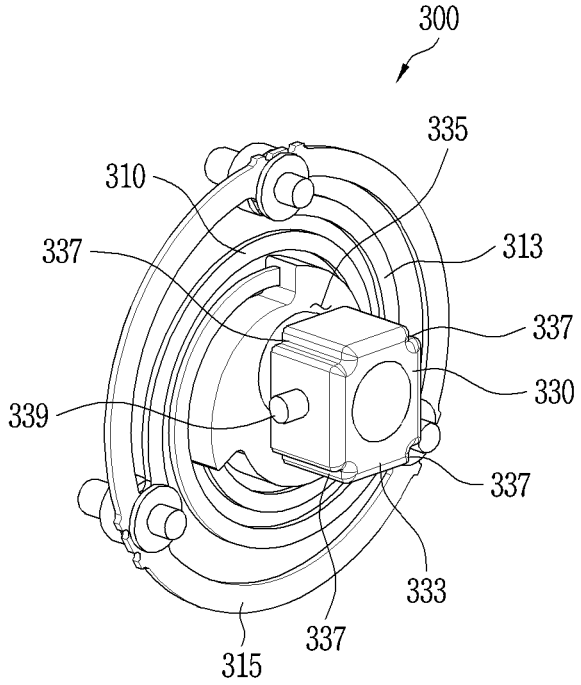
FIG. 7 is a perspective view showing a support device according to an embodiment of the present disclosure.

FIG. 7 is a perspective view showing a support device 300 according to an embodiment of the present disclosure.

The support device 300 according to an embodiment may include a support spring 310, a rigid connection portion 320, and an elastic connection portion 330.

The support spring 310 according to an embodiment may have a plate spring shape, may be engaged with the rear cover 1220 (see FIG. 3) of the compressor body 1000 and may be positioned vertically with respect to the axial direction of the compressor body 1000 (see FIG. 3).

The support spring 310 may absorb all vibrations occurring due to the weight of the compressor body 1000 and the operation of the compressor body 1000 based on the large lateral stiffness (e.g., stiffness against a force in a direction parallel to the plane of the plate spring).

In addition, the support spring 310 may absorb vibrations occurring in the axial direction of the compressor body 1000 due to the operation of the compressor body 1000 based on the small longitudinal stiffness (e.g., stiffness against a force in a direction perpendicular to the plane of the plate spring).

Therefore, the vibrations of the compressor body 1000 is effectively absorbed by the support spring 310 including the plate spring, and the compressor body 1000 may be prevented from colliding with the shell 110.

The support spring 310 according to an embodiment may include a central portion 311, an outer portion 315 radially outwardly spaced apart from the central portion 311, and a spring arm 313 connecting the central portion 311, and the central portion 311 and the outer portion 315.

The spring arm 313 may be formed to extend from the central portion 311 to surround the central portion 311. Specifically, the spring arm 313 may extend from a plurality of points spaced apart in the circumferential direction in the central portion 311.

The plurality of points are disposed on the outer peripheral surface of the central portion 311 and may be points spaced apart at predetermined intervals in the circumferential direction.

For example, the number of the plurality of points may be at least three. The plurality of points may be arranged at equal intervals.

The spring arm 313 may extend in a spiral shape from the plurality of points and be connected to the outer portion 315. That is, it can be understood that a plurality of spring arms 313 extending from the plurality of points in the central portion 311 are provided and connected to the outer portion 315.

The spring arms 313 extending from the central portion 311 may be connected to each other in the outer portion 315 to form a circular shape and may be coupled to the rear cover 1220 (see FIG. 6).

Like the central portion 311, the outer portion 315 may be connected to the spring arm 313 at the plurality of points spaced apart from each other in the circumferential direction.

Fastening holes are formed at a plurality of points where the spring arms 313 and the outer portion 315 are connected, and fastening members pass through the fastening holes to be coupled with the rear cover 1220.

Figure 8:
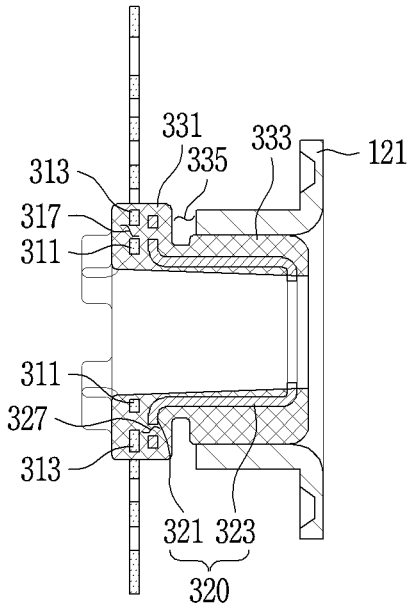
FIG. 8 is an enlarged cross-sectional view of part B of FIG. 5.

A hole may be formed in the central portion 311 as illustrated in FIG. 8. An inlet guide portion 1156 (see FIG. 5) may pass through the hole of the central portion 311 and a refrigerant supplied through the suction pipe 141 (see FIG. 5) may be supplied to the cylinder 1120 (see FIG. 4) through the inlet guide portion 1156.

By arranging the hole such that the inlet guide portion 1156 passes through the central portion 311 of the support spring 310, the refrigerant may be supplied from the suction pipe 141 to the cylinder 1120 (see FIG. 4) in the shortest distance. Through this, it is possible to increase the efficiency of the refrigerant supply and reduce the piping, thus reducing the volume of the linear compressor 100.

The outer portions 315 of the support spring 310 according to an embodiment may be connected to each other in a single circular shape, so that weights transferred from the plurality of spring arms 313 may be connected to each other and redistributed. Through this, the plurality of spring arms 313 may be operated as a single support spring 310.

In other words, it may be understood that the outer portions 315 are formed in a ring shape and are connected to the plurality of spring arms 313 at a plurality of points spaced apart from each other in the circumferential direction.

The spring arms 313 of the support spring 310 according to an embodiment may extend from a plurality of points of the central portion 311. For example, as illustrated in FIG. 7, the spring arms 313 may be formed to extend from three points at equal intervals with respect to the central portion 311.

By arranging a plurality of points for extension at equal intervals, a uniform elastic force may be provided to the compressor body 1000 regardless of the direction in which the support spring 310 is coupled to the rear cover 1220.

The elastic connection portion 330 according to an embodiment may connect the support device 300 and the first shell cover 120 (see FIG. 5). More specifically, the elastic connection portion 330 is formed in the shape of a protrusion connected to the central portion 311 of the support spring 310, and the protrusion is inserted into the cover support portion 121 of the first shell cover 120 to connect the support device 300 and the first shell cover 120.

The elastic connection portion 330 is formed of an elastic material such as rubber to absorb noise and vibration occurring during the operation of the compressor body 1000. Through this, noise and vibration caused in the compressor body 1000 may be prevented from being transferred to the first shell cover 120, thus reducing operation noise of the linear compressor 100.

However, the elastic connection portion 330 may lack rigidity to maintain a state of being inserted into the cover support portion 121 due to characteristics of a material such as rubber to absorb noise and vibration. For example, the compressor body 1000 may be shaken by an impact that may occur during the transportation of the linear compressor 100 or the like, and the elastic connection portion 330 may be deformed and detached from the cover support portion 121 due to the continuous vibration occurring during the operation of the compressor body 1000.

Therefore, the support device 300 according to an embodiment of the present disclosure may further include a rigid connection portion 320 to limit the elastic deformation range of the elastic connection portion 330, thus solidifying the connection state between the elastic connection portion 330 and the cover support portion 121. More details will be described with reference to FIG. 8.

FIG. 8 is an enlarged cross-sectional view of part B of FIG. 5. More specifically, FIG. 8 is a cross-sectional view showing a coupling relationship between the support spring 310, the rigid connection portion 320, the elastic connection portion 330, and the cover support portion 121.

The elastic connection portion 330 according to an embodiment may include an elastic flange 331 connected to the support spring 310 and an elastic protrusion 333 connected to the first shell cover 120.

Specifically, the elastic flange 331 is coupled to the central portion 311 of the support spring 310, the elastic protrusion 333 is inserted into the cover support portion 121 to finally connect the compressor body 1000 and the first shell cover 120.

However, as described above, it may be difficult to secure coupling reliability between the compressor body 1000 and the first shell cover 120 using only the elastic connection portion 330 made of an elastic material.

Therefore, the support device 300 according to an embodiment is provided with a rigid connection portion 320 received in the elastic connection portion 330 so as to limit the elastic deformation range of the elastic protrusion 333 while maintaining the effect of blocking vibration and noise by the elastic connection portion 330.

The rigid connection portion 320 may be spaced apart from the support spring 310 in the axial direction of the compressor in a state of being received in the elastic connection portion 330.

The rigid connection portion 320 according to an embodiment may include a rigid flange 321 radially extending in a radial direction and a rigid protrusion 323 extending in an axial direction from the rigid flange 321.

The rigid flange 321 may be received in the elastic flange 331, and the rigid protrusion 323 may be received in the elastic protrusion 333.

The rigid flange 321 may be formed to face a certain area of the central portion 311 of the support spring 310 and may be spaced apart from the support spring 310 by a predetermined distance.

Since noise and vibration caused in the compressor body 1000 may be directly transferred when the support spring 310 and the rigid flange 321 are in direct contact with each other, the support spring 310 and the rigid flange 321 may be arranged to be spaced apart from each other by a predetermined distance.

The rigid protrusion 323 may be connected to the rigid flange 321 and may protrude from the rigid flange 321 along the axial direction of the compressor body 1000.

The rigid protrusion 323 may protrude from the rigid flange 321 in a direction away from the support spring 310.

The shape of the cross section of the rigid protrusion 323 may be a circular shape but is not limited thereto and may have various shapes.

The rigid connection portion 320 as described above may be formed of a material such as metal and may serve as an internal frame of the elastic connection portion 330.

The elastic connection portion 330 having the rigid connection portion 320 according to an embodiment may be provided such that the rigid flange 321 and the central portion 311 are coupled to the elastic flange 331 in a state in which the rigid flange 321 and the central portion 311 of the support spring 310 are spaced apart from each other by a predetermined distance.

In the state in which the elastic connection portion 330 is inserted into the cover support portion 121, the rigid protrusion 323 may be received in the elastic protrusion 333 to be spaced apart from the cover support portion 121.

That is, the rigid protrusion 323 is received in the elastic protrusion 333 to prevent direct contact between the rigid protrusion 323 and the cover support portion 121, thus blocking transmission of vibration and noise caused by collision between the rigid protrusion 323 and the cover support portion 121 and simultaneously reducing the degree of elastic deformation of the elastic protrusion 333 to prevent the elastic protrusion 333 from being detached from the cover support portion 121.

Referring to FIG. 8, according to an embodiment, the rigid connection portion 320 and the elastic connection portion 330 have holes passing through centers thereof respectively. Holes may also be formed in the rigid connection portion 320 and the elastic connection portion 330 to correspond to the hole of the central portion 311 of the support spring 310 in order to avoid interference with the inlet guide portion, that is a movement path of a sucked refrigerant.

The holes are arranged such that the inlet guide portion passes through all the central portion 311 of the support spring 310, the rigid connection portion 320, and the elastic connection portion 330, so that it is possible to supply a refrigerant in the shortest distance from the suction pipe 141 (see FIG. 5) to the cylinder, increase the efficiency of the refrigerant supply, and at the same time, reduce the piping to reduce the volume of the linear compressor 100.

According to an embodiment, a groove 335 may be formed to be recessed from an outer peripheral surface may be disposed in a portion where the elastic flange 331 and the elastic protrusion 333 are connected. That is, it may be understood that the groove 335 is formed to be recessed from the outer peripheral surface of the elastic protrusion 333 toward the axis of the compressor body 1000.

The groove 335 may be positioned closer to the elastic flange 331 than the first shell cover 120.

In addition, in the state in which the elastic connection portion 330 is inserted into the cover support portion 121 based on FIG. 8, the groove 335 may be disposed in front of the cover support portion 121 in the axial direction of the compressor body 1000.

Therefore, the vibration caused by the weight of the compressor body 1000 or the vibration generated during the operation of the compressor body 1000 is absorbed as the groove 335 is deformed, thereby minimizing the vibration transmitted to the elastic protrusion 333.

For example, the groove 335 may absorb vibration in the up-down direction or the front-rear direction based on the illustrated state of FIG. 8 to prevent the elastic protrusion 333 from being detached from the cover support portion 121 due to repetitive vibration.

The elastic connection portion 330 according to an embodiment may be injection-molded by using the support spring 310 and the rigid connection portion 320 as inserts, thus being integrally formed with the support spring 310 and the rigid connection portion 320.

Figure 9:
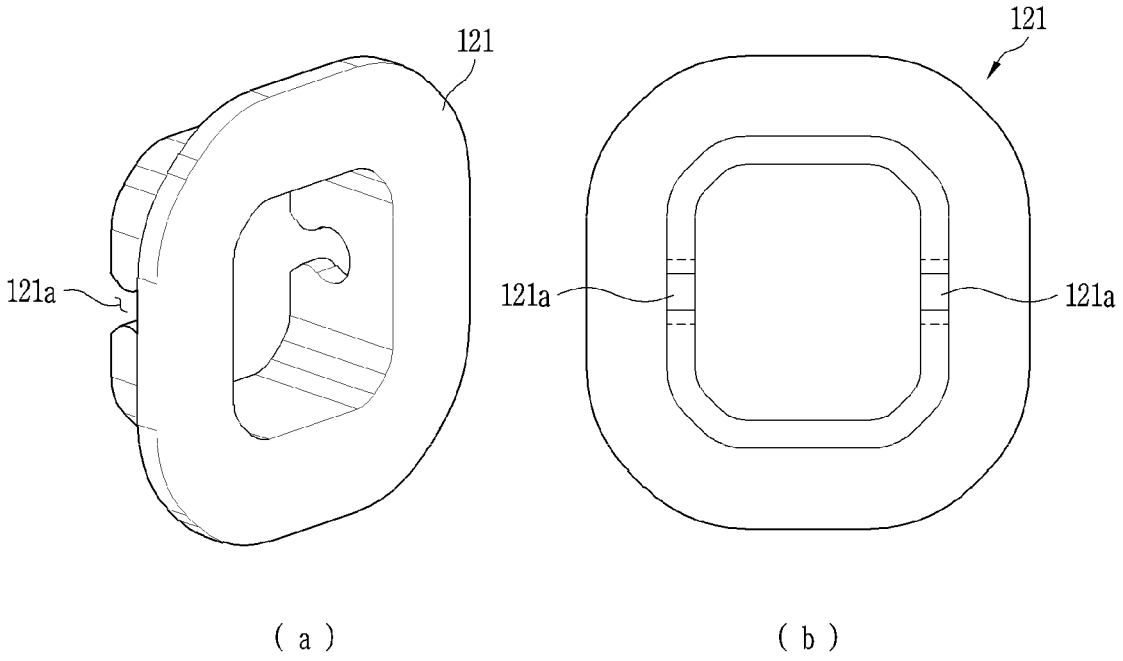
FIG. 9(*a*) is a perspective view of a cover support of a linear compressor according to an embodiment of the present disclosure, and FIG. 9(*b*) is a front view of the cover support.
Figure 10:
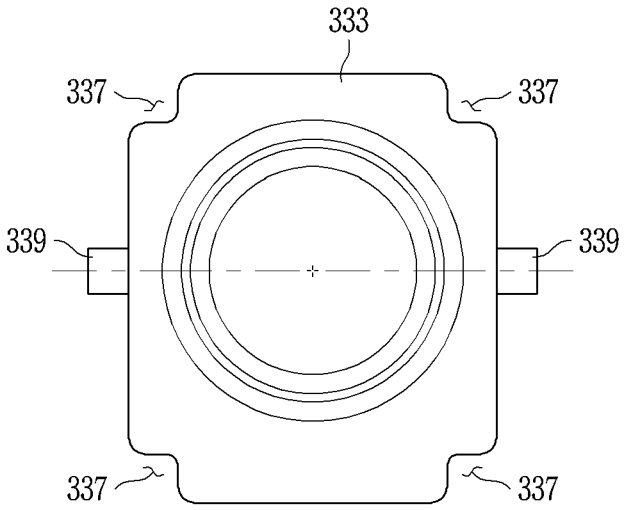
FIG. 10 is a view showing an elastic protrusion of a support device according to an embodiment of the present disclosure.

FIG. 9(*a*) is a perspective view of the cover support portion 121 of the linear compressor 100 according to an embodiment of the present disclosure, FIG. 9(*b*) is a front view of the cover support portion 121, and FIG. 10 is a cross-sectional view of the elastic protrusion 333 of the support device 300 according to an embodiment of the disclosure.

Referring to FIGS. 9(*a*) to 9(*b*), the cover support portion 121 has a rectangular-shaped cross-section that elongates in the up-down direction, four vertexes the rectangular-shaped cross-section being formed to be chamfered. The cover support portion 121 may be disposed on the first shell cover 120 to have a rectangular-shaped cross-section that elongates along the direction in which the weight of the compressor body 1000 is applied.

In other words, the cross section of the cover support portion 121 may be formed such that a length in the up-down direction is longer than a length in the left-right direction (horizontal direction).

At least a portion of the cover support portion 121 may be formed to have an outer shape of a square pillar shape. In this case, the four edges of the cover support portion 121 disposed in the direction parallel to the axial direction of the compressor body 1000 may be formed to be chamfered.

Similarly, referring to FIG. 10, the elastic protrusion 333 may also be formed to have a rectangular cross-section that elongates in the up-down direction. In other words, the elastic protrusion 333 may have a square pillar-like shape.

In other words, the cross section of the elastic protrusion 333 may be formed such that a length in the up-down direction is longer than a length in the left-right direction (horizontal direction).

The elastic protrusion 333 may be coupled to the support spring 310 in a rectangular shape formed to elongate along the direction in which the weight of the compressor body 1000 is applied.

In addition, the length of the elastic protrusion 333 in the up-down direction and the length of the elastic protrusion 333 in the left-right direction may be formed to be longer than the length of the cover support portion 121 in the up-down direction and the length of the cover support portion 121 in the left-right direction, respectively. That is, the elastic protrusion 333 may be pressed and deformed to be press-fitted to the cover support portion 121.

The axial length of the edge of the cover support portion 121 may be shorter than the axial length of the edge of the elastic protrusion 333 corresponding to the edge of the cover support portion 121.

A strain absorbing groove 337 may be disposed at an edge of the elastic protrusion 333, parallel to the axial direction of the compressor.

In detail, the strain absorbing groove 337 may be formed to be recessed in the direction toward the axis of the compressor body 1000 from the outer peripheral surface of the elastic protrusion 333 where the edge is positioned.

In the process in which the elastic protrusion 333 is press-fitted into the cover support portion 121 by the strain absorbing groove 337, a portion of the elastic protrusion 333 that is pressed and deformed is filled into the strain absorbing groove 337 to be easily coupled thereto.

The hole formed in the elastic protrusion 333 according to an embodiment may be disposed to be deviated from the central axis of the elastic protrusion 333.

Referring to FIG. 10, the hole formed in the elastic protrusion 333 may be disposed to be biased upward than the central axis of the elastic protrusion 333. In other words, the hole formed in the elastic protrusion 333 may be disposed to be biased in a direction opposite to the direction in which the weight of the compressor body 1000 is applied.

The weight of the compressor body 1000 may always be applied downward of the elastic protrusion 333 regardless of whether the compressor body 1000 is operated. Therefore, by the arrangement of the holes formed in the elastic protrusion 333, the lower portion of the elastic protrusion 333 may be formed to be sufficiently thick to withstand not only vibrations occurring during the operation of the compressor body 1000 but also the weight of the compressor body 1000 itself.

In addition, the elastic protrusion 333, when viewed in the axial direction of the compressor body 1000, may be disposed such that the center of the rigid protrusion 323 and the center of the elastic protrusion 333 are deviated from each other.

That is, the center of the rigid protrusion 323 may not be positioned on an imaginary straight line passing through the center of the elastic protrusion 333 and parallel to the axis of the compressor body 1000. For example, the center of the rigid protrusion 323 may be positioned above the center of the elastic protrusion 333.

Fixing protrusions 339 may be formed on two opposite surfaces of the outer peripheral surfaces of the elastic protrusion 333 according to an embodiment.

The fixing protrusions 339 may protrude from two opposite surfaces of the peripheral surfaces of the elastic protrusion 333. In detail, the fixing protrusion 339 may protrude from the two surfaces in a direction perpendicular to the axial direction of the compressor.

Fixing grooves 121*a* into which the fixing protrusions 339 are inserted may be formed in the cover support portion 121. The fixing grooves 121*a* may be formed at positions corresponding to the fixing protrusions 339.

When the elastic protrusion 333 is press-fitted into the cover support portion 121, at least a portion of the fixing protrusion 339 may protrude from the fixing groove 121*a* while the fixing protrusion 339 is inserted into the fixing groove 121*a*. That is, when the fixing protrusion 339 is inserted into the fixing groove 121*a*, the user may visually determine that the elastic protrusion 333 is completely inserted and coupled to the cover support portion 121.

Figure 11:
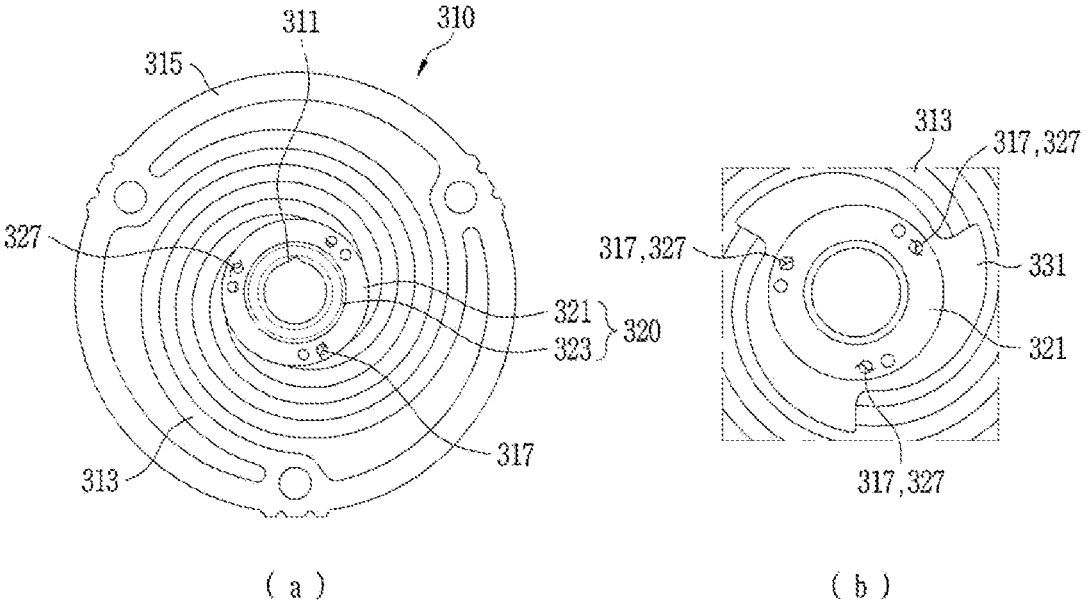
FIG. 11(*a*) is a view showing a part of the support device according to an embodiment of the present disclosure, and FIG. 11(*b*) is an enlarged and perspective view of a part of the support device according to an embodiment of the present disclosure.

FIG. 11(*a*) is a view showing the support device 300 according to an embodiment of the present disclosure, of which some components are omitted, and FIG. 11(*b*) is an enlarged and perspective view of a portion of the support device 300 according to an embodiment of the present disclosure.

More specifically, FIG. 11(*a*) is a plan view mainly showing the central portion 311 of the support spring 310 and the rigid connection portion 320, with the elastic connection portion 330 removed from the support device 300 according to an embodiment. FIG. 11(*b*) is a perspective view of the elastic flange 331 showing the positional relationship of the central portion 311 of the support spring 310, the rigid flange 321, and the elastic flange 331.

Referring to FIG. 11(*a*), a first alignment hole 317 may be formed in the central portion 311 of the support spring 310, and a second alignment hole 327 may be formed in the rigid flange 321.

The first alignment hole 317 may be formed at a position where the spring arm 313 extends from the central portion 311.

A plurality of first alignment holes 317 and a plurality of second alignment holes 327 may be formed and may be formed at corresponding positions to each other.

The first alignment holes 317 and the second alignment holes 327 may serve to fix the positions thereof in the process of insert injection molding of the elastic connection portion 330 using the support spring 310 and the rigid connection portion 320 as inserts. In addition, when the elastic connection portion 330 is injected, the support spring 310 and the rigid connection portion 320 are coupled to each other through the first alignment hole 317 or the second alignment hole 327 to be prevented from being rotated with each other.

It will be apparent to those skilled in the art that the present disclosure may be embodied in other specific forms without departing from the spirit and essential features of the present disclosure.

The above detailed description should not be construed as limiting in all respects, but should be considered illustrative. The scope of the disclosure should be determined by rational interpretation of the appended claims, and all changes within the equivalent scope of the disclosure are included in the scope of the disclosure.

According to various embodiments of the present disclosure, the range in which the compressor body of the linear compressor floats inside the shell may be limited.

According to various embodiments of the present disclosure, as the floating range of the compressor body is limited, it is possible to prevent the compressor body or components of the compressor body from colliding with the shell and being damaged.

According to various embodiments of the present disclosure, it is possible to reduce noise and vibration from being transmitted outside the linear compressor by arranging a structure capable of blocking and absorbing transmission of vibration in a support structure connecting the compressor body to the shell cover.

What is claimed is:

1. A linear compressor comprising:

a shell;

a shell cover that covers an open end of the shell;

a compressor body disposed in the shell and configured to compress a refrigerant; and a support device that (i) connects the compressor body to the shell cover and (ii) prevents the compressor body from contacting an inner peripheral surface of the shell;

wherein the support device includes:

a support spring that has (i) a central portion, (ii) an outer portion, and (iii) a hole at the central portion, the support spring having at least one spiral spring arm that extends from the central portion to the outer portion, at least a portion of the outer portion being connected to the compressor body;

a rigid connection portion that is spaced apart from the support spring; and an elastic connection portion that (i) at least partially surrounds the hole of the support spring, (ii) connects the support spring to the rigid connection portion, and (iii) is coupled to the shell cover, wherein a cover support portion is disposed at an inner surface of the shell cover, and wherein the rigid connection portion is embedded in the elastic connection portion, spaced apart from the support spring, and spaced apart from the cover support portion.

2. The linear compressor of claim 1, wherein the at least one spiral spring arm includes a plurality of spiral spring arms, and wherein the support spring has a plate spring shape and includes the plurality of spiral spring arms that extend from a plurality of points at the central portion toward the outer portion, the plurality of points being spaced equally from each other at the central portion.

3. The linear compressor of claim 2, wherein the plurality of points is three or more points.

4. The linear compressor of claim 3, wherein the plurality of spiral spring arms are connected to each other and the outer portion defines a circle.

5. A linear compressor comprising:

a shell;

a shell cover that covers an open end of the shell;

a compressor body disposed in the shell and configured to compress a refrigerant and a support device that (i) connects the compressor body to the shell cover and (ii) prevents the compressor body from contacting an inner peripheral surface of the shell;

wherein the support device includes:

a support spring that has (i) a central portion, (ii) an outer portion, and (iii) a hole at the central portion, the support spring having at least one spiral spring arm that extends from the central portion to the outer portion, at least a portion of the outer portion being connected to the compressor body;

a rigid connection portion that is spaced apart from the support spring; and an elastic connection portion that (i) at least partially surrounds the hole of the support spring, (ii) connects the support spring to the rigid connection portion, and (iii) is coupled to the shell cover, wherein the rigid connection portion includes:

a rigid flange that faces the central portion of the support spring and is spaced apart from the support spring; and a rigid protrusion that is (i) connected to the rigid flange, (ii) protrudes from the rigid flange along an axial direction of the compressor body, and (iii) provides an internal frame of the elastic connection portion.

6. The linear compressor of claim 5, wherein the central portion of the support spring includes at least one first alignment hole, wherein the rigid flange includes at least one second alignment hole, and wherein the at least one first alignment hole is disposed to partially correspond to the at least one second alignment hole.

7. The linear compressor of claim 6, wherein the at least one first alignment hole includes a plurality of first alignment holes, wherein the at least one spiral spring arm includes a plurality of spiral spring arms, and wherein the central portion of the support spring includes the plurality of first alignment holes that are disposed at positions of the central portion from which the plurality of spiral spring arms extend .

8. The linear compressor of claim 7, wherein the plurality of first alignment holes are equally spaced from each other along a circumferential direction around the hole of the support spring.

9. The linear compressor of claim 5, wherein the elastic connection portion includes:

an elastic flange that surrounds the rigid flange and the central portion of the support spring; and an elastic protrusion that surrounds the rigid protrusion and is coupled to the shell cover.

10. The linear compressor of claim 9, wherein the elastic flange surrounds the central portion of the support spring and at least a portion of the spring arm.

11. The linear compressor of claim 10, wherein the elastic protrusion has a groove that extends from an outer peripheral surface of the elastic protrusion toward an axis of the compressor body, and wherein the groove is disposed closer to the elastic flange than the shell cover.

12. The linear compressor of claim 11, wherein an exterior of the elastic protrusion has a pillar shape.

13. The linear compressor of claim 12, wherein the elastic protrusion extends along the axial direction of the compressor body, and wherein the elastic protrusion includes a strain absorbing groove that extends along the axial direction of the compressor body.

14. The linear compressor of claim 13, wherein the elastic protrusion has fixing protrusions that are disposed at opposite surfaces of the elastic protrusion.

15. The linear compressor of claim 14, wherein the shell cover includes a cover support portion that is coupled to the elastic protrusion, and wherein the cover support portion includes fixing grooves that correspond to the fixing protrusions of the elastic protrusion.

16. The linear compressor of claim 15, wherein the cover support portion has a shape that corresponds to the elastic protrusion and that has a rectangular cross section along the axial direction of the compressor body, and wherein the cover support portion has a chamfered axial edge.

17. The linear compressor of claim 16, wherein the cover support portion has an axial length that is shorter than an axial length of the elastic protrusion.

18. The linear compressor of claim 9, wherein the shell cover includes a cover support portion that is coupled to the elastic protrusion, and wherein the elastic protrusion is press-fitted to the cover support portion.

19. The linear compressor of claim 18, wherein the rigid protrusion is spaced apart from the cover support portion that is coupled to the elastic protrusion.

20. The linear compressor of claim 9, further comprising:

an inlet guide portion that is in fluid communication with the hole in the central portion of the support spring and is configured to supply the refrigerant to a cylinder of the compressor body, wherein the rigid connection portion and the elastic connection portion have a hole that is in fluid communication with the inlet guide portion.

* * * * *